US006102397A

United States Patent [19]

Lee et al.

[11] Patent Number: 6,102,397

[45] Date of Patent: Aug. 15, 2000

[54] COMPUTER INTERFACE APPARATUS FOR AN AMUSEMENT DEVICE

[76] Inventors: Dennis H Lee, 1904 Wilshire Ct., Somerville, N.J. 08876; Jie Huang, 438 Conover Dr., Neshanic, N.J. 08853

[21] Appl. No.: 08/858,216

[22] Filed: May 10, 1997

Related U.S. Application Data

[60] Provisional application No. 60/017,471, May 10, 1996.

[51] Int. Cl.[7] ..... A63F 3/00

[52] U.S. Cl. ..... 273/238; 273/284; 463/1; 463/14; 463/46

[58] Field of Search ..... 273/236, 237, 273/238, 239, 242, 287, 288, 284; 463/1, 9, 14, 16, 46

[56] References Cited

U.S. PATENT DOCUMENTS

| | | | |
|---|---|---|---|
| 5,121,926 | 6/1992 | Pfaender | 273/236 |
| 5,290,038 | 3/1994 | Khin | 273/238 |
| 5,356,155 | 10/1994 | Gross | 273/284 |
| 5,393,074 | 2/1995 | Bear | 273/440 |

*Primary Examiner*—Michael O'Neill
*Attorney, Agent, or Firm*—LaMorte & Associates

[57] ABSTRACT

A device and method for interconnecting a computer or similar central processing unit with the physical structure of an amusement device so that the computer can participate during play. The device can be embodied within the amusement device or can be used in conjunction with an inlay that simulates a board game. In either scenario, a plurality of identification units are positioned in the amusement device at points where game pieces are used. The identification units sense the presence of a game piece as the game is played and the game pieces are moved. If an identification unit detects the presence of a game piece, the identification unit produces an output signal that is read by the computer. The output signal identifies both the location of the game piece and the type of game piece. As a result, the computer is informed as to the location and identity of all the game pieces used in the game. The computer can use this information to monitor the play of the game or participate in the play of the game.

10 Claims, 6 Drawing Sheets

COMPUTER INTERFACE APPARATUS FOR AN AMUSEMENT DEVICE

RELATED APPLICATIONS

This application is the United States filing that corresponds to Provisional Patent Application No. 60/017,471 filed May 10, 1996, entitled COMPUTER INTERACTIVE GAMEBOARD SYSTEM.

BACKGROUND OF THE INVENTION

1. Field of the Invention

In general, the present invention relates to computer interface devices that enable a user to read information to and from a computer. More specifically, the present invention relates to interface devices that enable games, toys and other amusement devices to read information to and from a computer.

2. Prior Art Statement

There are many different types of computer interface devices that exist in the prior art record. The primary purpose of a computer interface device is to enable a user to enter and retrieve data from a computer. Computer interfaces typically fall into one of two categories. Data input interfaces are used to enter data into a computer. The most common type of data input interface for a computer is the computer keyboard. A computer keyboard enables alphanumeric characters to be selectively entered as data into a computer. Other common types of data input interfaces for a computer include touch pads, touch screens, mouses, scanners, modems and the like. Data retrieval interfaces are used to read data from a computer. The most common types of data retrieval interfaces are display screens and printers.

In the prior art there are very few computer interface devices that are specifically designed for use with games, toys and other amusements. Of the few computer interfaces that do exist for amusement devices, many came into existence when circuitry was added to a conventional game. Over the years, various manufacturers have added processor circuitry to the physical structure of different games so that the role of at least one player can be played by the processor circuitry. In each instance, some mechanism was developed that informs the processor circuitry about the layout of the game, the position of the game pieces and the change in those positions after each move. Such an information exchange with the processor is required if the processor circuitry is going to participate in the play of the game. For example, there are many different manufacturers that make computerized chess games. In such games, the chess board contains a plurality of electronic trigger elements that are triggered by the playing pieces. As a result, the chess board acts as a computer interface that reads to a computer the location of the playing pieces as the playing pieces are moved across the board. Another example of a game/computer interface is found in U.S. Pat. No. 5,393,074 to Bear, entitled MODULAR ELECTRONIC GAMING SYSTEM. In this patent, a computer is connected to a game board having a game path that can be custom designed. As the game path on the board is designed, the computer recognizes the pattern and directs play accordingly.

Although processor circuitry has been added to many different games, many others games have never been updated. One class of games that have typically not been updated with electronics are classic board games. Classic board games include such games as Monopoly®, Life®, Candyland®, Risk®, Scrabble® and the like. Rather than adding electronics to the structure of classic board games, classic board games have commonly been converted into software packages that can be run by a personal computer. As such, instead of processor circuity being added to the structure of the board game, the structure of the board game is converted to imagery that is reproduced on a computer screen. For example, if a player were to run a Monopoly® game program on his/her computer, the game board, playing pieces, money, cards and dice would be reproduced on the computer screen. The player would then interact with the computer using the computer keyboard or mouse. Despite how good a computer programs graphics may be, playing a game on a computer screen is rarely as good as viewing the real physical game. similarly, clicking a mouse to move an icon on a computer screen is not as fun as physically grasping a playing piece and moving it around a board. Another disadvantage of game software is that the screen used to display the game board is often small. It is therefore very difficult for multiple people to view the computer screen simultaneously in order to determine the position of their game pieces and the game pieces of the other players.

A need therefore exists in the art for a way to interface board games and other amusement devices with a computer so that the physical structure of the game is not significantly altered, yet a computer is enabled to communicate with the structure of the game so that it can participate in the play of the game. This need is met by the present invention as described and claimed below.

SUMMARY OF THE INVENTION

The present invention is a device and method for interconnecting a computer or similar central processing unit with the physical structure of an amusement device so that the computer can participate during play. The device can be embodied within the amusement device or can be used in conjunction with an inlay that simulates a board game. In either scenario, a plurality of identification units are positioned in the amusement device at points where game pieces are used. The identification units sense the presence of a game piece as the game is played and the game pieces are moved. If an identification unit detects the presence of a game piece, the identification unit produces an output signal that is read by the computer. The output signal identifies both the location of the game piece and the type of game piece. As a result, the computer is informed as to the location and identity of all the game pieces used in the game. The computer can use this information to monitor the play of the game or participate in the play of the game. Since the computer has the ability to identify the type of game pieces being used, multiple different games can be played using the same common interface structure.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE DRAWINGS

Figure 1:
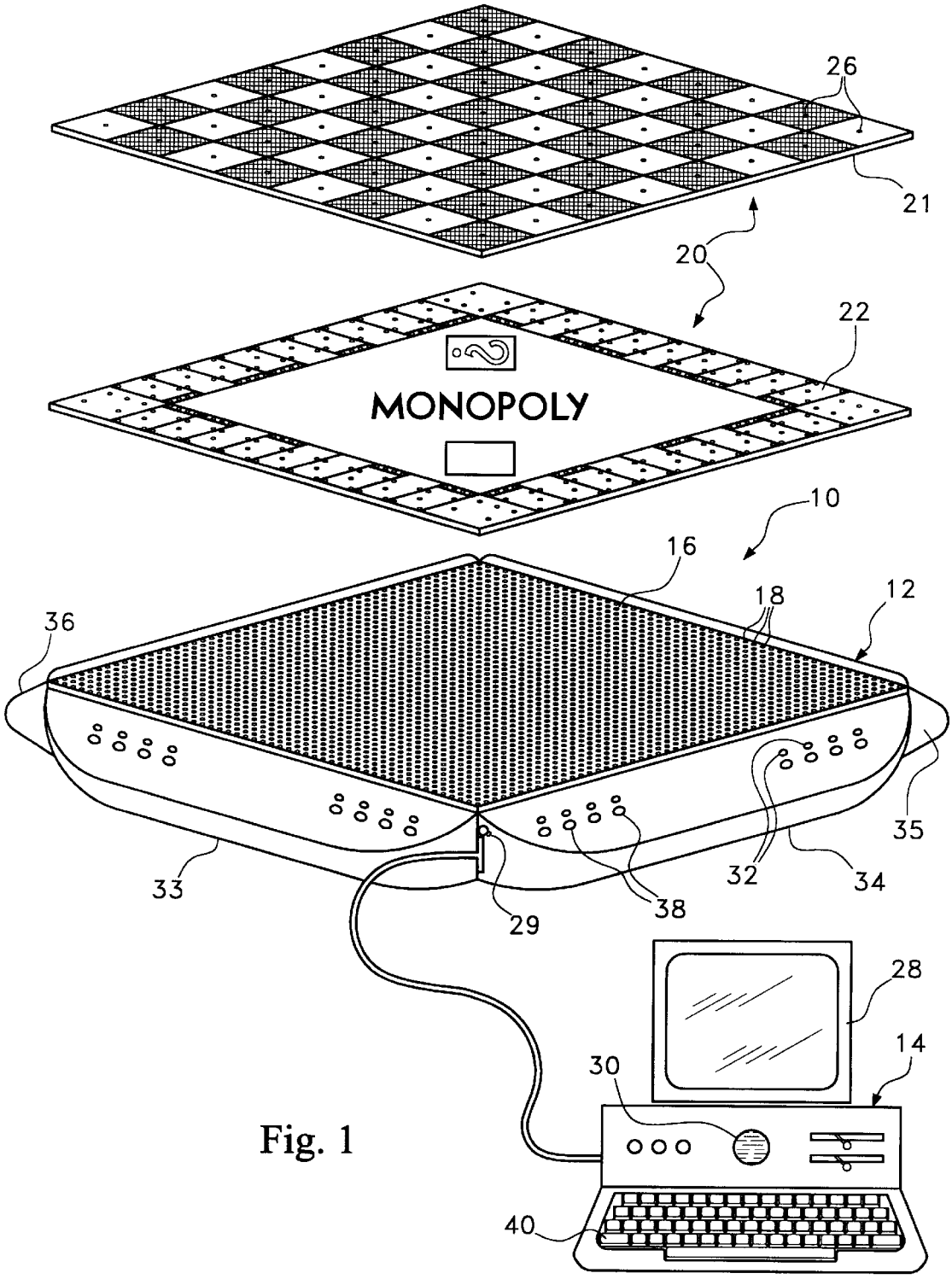
FIG. 1 is a perspective view of one exemplary embodiment of a computer interface device in accordance with the present invention. The embodiment is shown in conjunction with a personal computer and two board game inlays.

Referring to FIG. 1, a first exemplary embodiment of the present invention device 10 is shown. The device 10 includes an interface assembly 12 that enables board games and other amusement products to be interconnected with a computer or similar central processing unit 14. In the embodiment of FIG. 1, the interface assembly 12 is configured to receive a board game. The interface assembly 12 has a planar top surface 16 upon which is disposed a matrix of holes 18. Different board games inlays 20 are provided wherein each board game inlay 20 is sized to fit across the planar top surface 16 of the interface assembly 12. For the purposes of example, two game board inlays 21, 22 are shown. The first inlay 21 is a checker board and the second inlay 22 is the board from the game of Monopoly®. Checker boards are used to play the games of checker and chess are well known games that do not need be to explained in this disclosure. Monopoly® is a well known game described in U.S. Pat. No. 2,026,082 to Darrow, entitled GAME BOARD APPARATUS. The use of a checker board and a Monopoly® board are used as well known examples of game boards. However, it should be understood that an inlay 20 from any other known board game can also be used.

Many board games have playing spaces across which game pieces move. In checkers, the board is equally divided into sixty four squares. In Monopoly®, a path is laid along the periphery of the game board. In other games, the playing path is convoluted and wanders across the entire board. Regardless of the game board inlay 20 being used, at each space on the inlay 20 there is provided at least one hole 26 that passes through the material of the inlay 20. As the game board inlay 20 is placed onto the planar top surface 16 of the interface assembly 12, each of the holes 26 in the game board inlay 20 aligns with one of the holes 18 in the matrix of holes disposed along the planar top surface 16.

The interface assembly 12 is coupled to a central processing unit (CPU) 14. The CPU 14 can be contained in a remote computer, as is shown, or the CPU can be contained within the confines of the interface assembly 12 itself. The CPU 14 is also connected to a display screen 28. If the CPU 14 is a remote personal computer, then the computer screen serves as the display 28. In an embodiment where the CPU 14 is contained within the interface assembly 12, the interface assembly 12 can have an optional coaxial cable attachment port 29 that would enable the interface assembly 12 to be connected to a television set.

The purpose of the interface assembly 12 is to act as an interface between the players of the game and the CPU 14 and to exchange information between the players and the CPU 14. The CPU 14 provides information to the players in one of three ways. First, the CPU 14 can generate images and messages on the display screen 28 for the players to read. The display screen 28 can show the game board, the status of the game, rules, current playing status and the like. The second way the CPU 14 can purvey information to the players is audibly. If the CPU 14 is coupled to a speaker, buzzer or other sound producing device 30, that CPU 14 can generate sounds. The sounds can be a synthesized voice that provides instructions or can be a simple tone that indicates a player has made an illegal move in the game. The third manner that the CPU 14 can relay information to the players is through the use of lights 32 on the interface assembly 12 itself. The interface assembly 12 is configured to contain a plurality of playing stations 33, 34, 35, 36. Each playing station 33, 34, 35, 36 preferably contains at least one set of lights 32 and at least one set of buttons 38. The lights 32 are capable of being lit by the CPU 14. As such, the CPU 14 can instruct a player to select a button 38 or just remind a player that it is his/her turn to play.

In order for the CPU 14 to participate in the play of any game, the CPU 14 may know the layout of the game, the rules of the game, the number of players, the position of the various playing pieces on the game board and the status of secondary playing pieces such as cards, play money, dice and the like. The interface assembly 12 requires specialty game inlays 20 to be used. These specialty game inlays 20 can be sold with the interface assembly 12 or can be sold individually. Regardless to the source of the game inlays 20, the number of possible game inlays 20 for classic board games will be a finite number that is most probably less than fifty. Each game inlay 20 can be assigned a code number. That code number can be read to the CPU 14 using the computer keypad 40 or the buttons 38 on the interface assembly 12. Once the code number has been read, the CPU 12 can retrieve the rules of the game that correspond to that code number from a memory source such as a disk. The CPU 12 can also retrieve the configuration of the selected game from memory. The number of players can also be entered via the computer keyboard 40 or the buttons 38 on the interface assembly 12.

Figure 2:
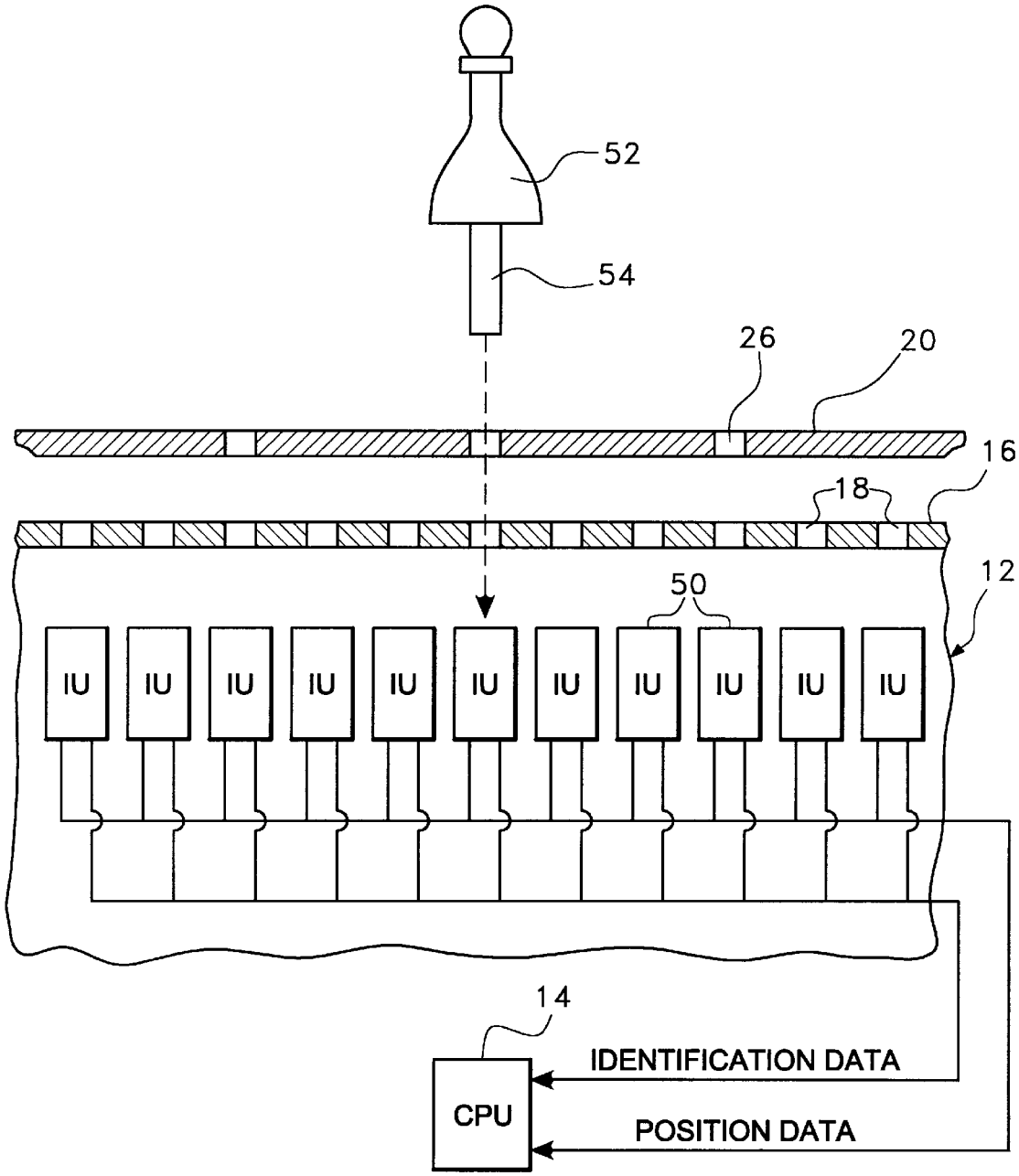
FIG. 2 is a schematic diagram showing a game piece and the interaction of the game piece with identification units located within the computer interface device.

The status of the various game pieces used in a game is read to the CPU 14 by the physical movement of the game pieces over the game inlay 20. Referring to FIG. 2, it can be seen that as a game inlay 20 is placed over the interface assembly 12, the holes 26 in the inlay 20 align with some of the holes 18 on the planar top surface 16 of the interface assembly 12. Below each of the holes 18 in the interface assembly 12 is an identification unit 50. Each of the game pieces 52 of the games to be played, is modified by adding a pin element 54 to the bottom of the game piece 52. As a game piece 52 is set into play, the pin element 54 of that game piece 52 passes though a hole 26 in the game inlay 20, passes through a hole 18 in the planar top surface 16 of the interface assembly 12 and engages one of the identification units 50. Each identification unit 50 performs two functions. First, the identification unit 50 provides the CPU 14 with the position of that game piece 52. From this information, the CPU 14 can determine where on the game board that playing piece has just been placed. Second, the identification unit 50 reads the identity of that game piece 52. For example, in chess, the identification units 50 can read if a playing piece is a pawn, knight, queen or the like. In checkers, the identification units 50 can read if a game piece is black or red. In Monopoly®, the identification units 50 can read if a game piece is the hat, a thimble or a shoe.

Figure 3:
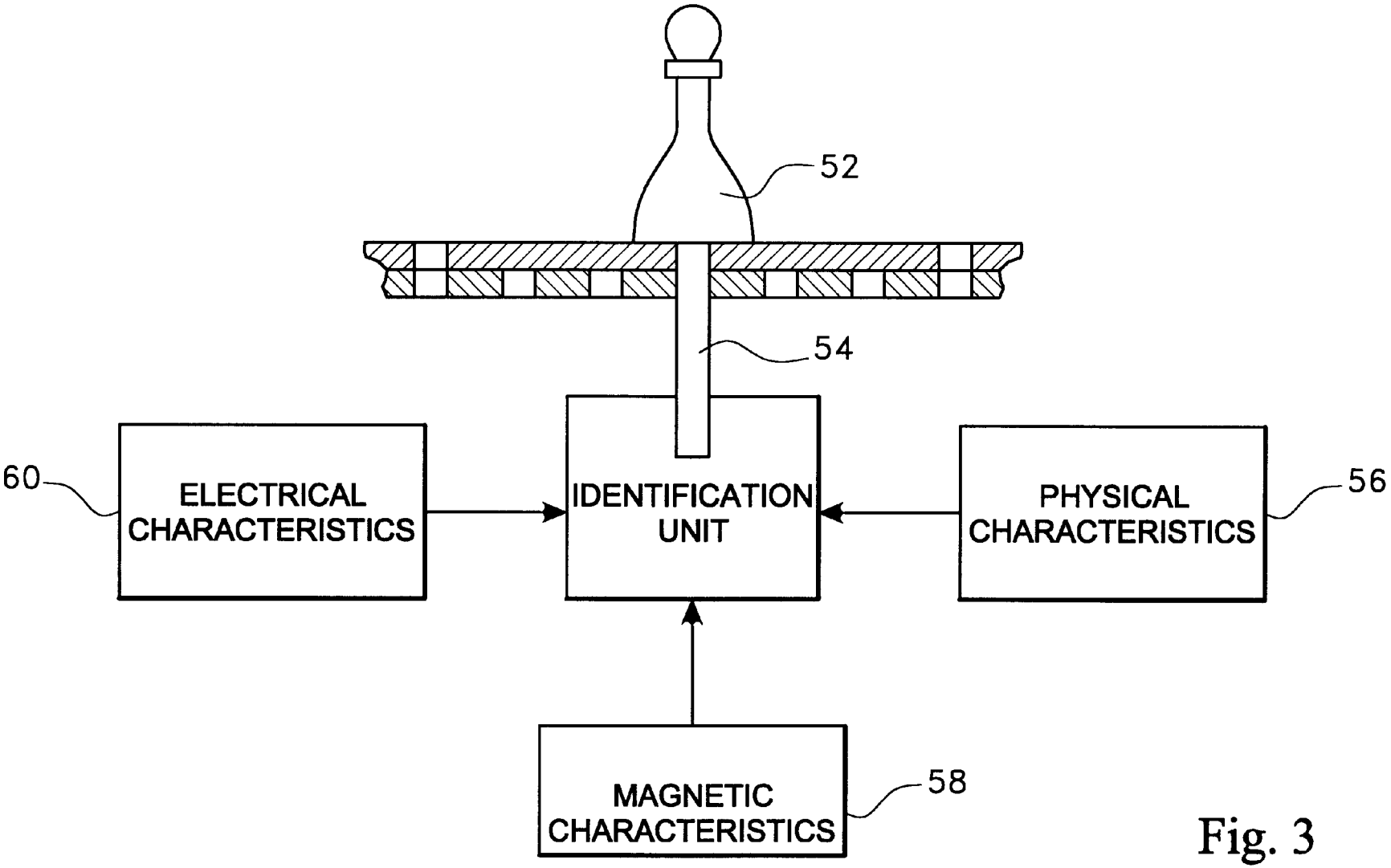
FIG. 3 is a schematic view illustrating the manner by which the identification units identify the various game pieces.

Referring to FIG. 3, it can be seen that the identification units 50 identify each game piece 52 in one of three possible ways. The first possible method of identification, as shown by block 56, relies upon the physical characteristics of the pin element 54 that extends below the game piece 52. The identification units can identify games pieces by the length, thickness or configuration of the pin elements extending from those game pieces by using optical sensors and/or physical switches. The second possible method of identification, as indicated by block 58, relies upon the magnetic properties of the game piece 52 and its pin element 54. Using reed switches or other electromagnetic components, game pieces 52 having magnets of different strengths or magnets at different points in the pin element 54 can be identified. In the third possible method of identification, as indicated by block 60, the identification of each game piece 52 is dependent upon the electrical properties of the game piece 52 and its pin element 54. Each game piece 52 can contain a circuit within its structure that produces a unique resistance, impedance, or like electronic signature that can be used to identify and distinguish that game piece 52.

Figure 4:
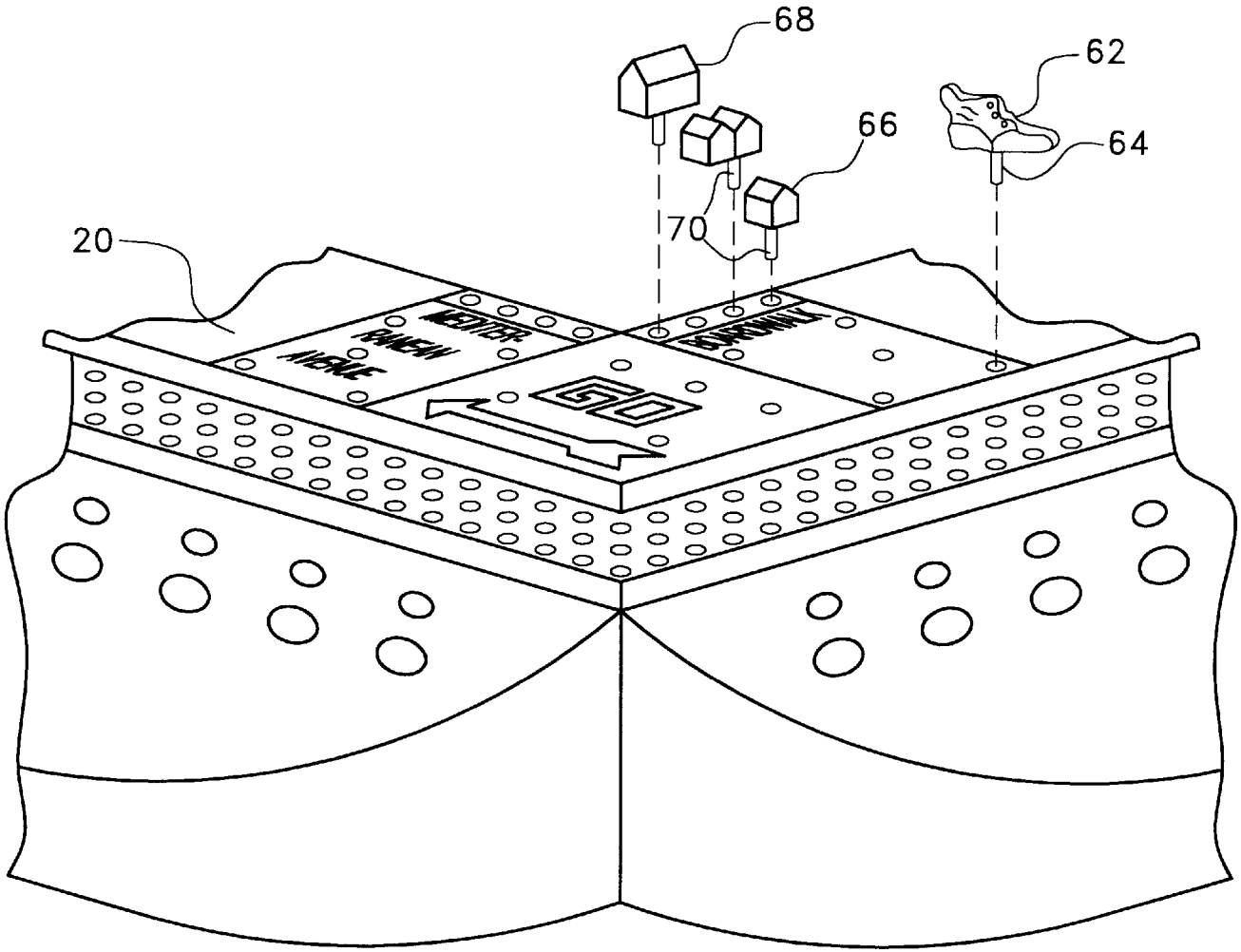
FIG. 4 is a perspective view showing a corner of a board game inlay with a variety of different game pieces.

Referring to FIG. 4, a segment of the game Monopoly® is shown. From this segment, it can be seen that not only the game pieces 62 have pin elements 64 that pass into the game inlay 20, but secondary pieces such as houses 66, hotels 68 and the like also have pin elements 70 that pass into the game layout 20. The pin elements 70 on the secondary pieces are identified in the same manner as are the game pieces. As a result, the CPU 14 (FIG. 1) can tell if a property has one house, two houses, three houses or a hotel. The CPU can then react accordingly in compliance to the rules of the game during the course of play.

Figure 5:
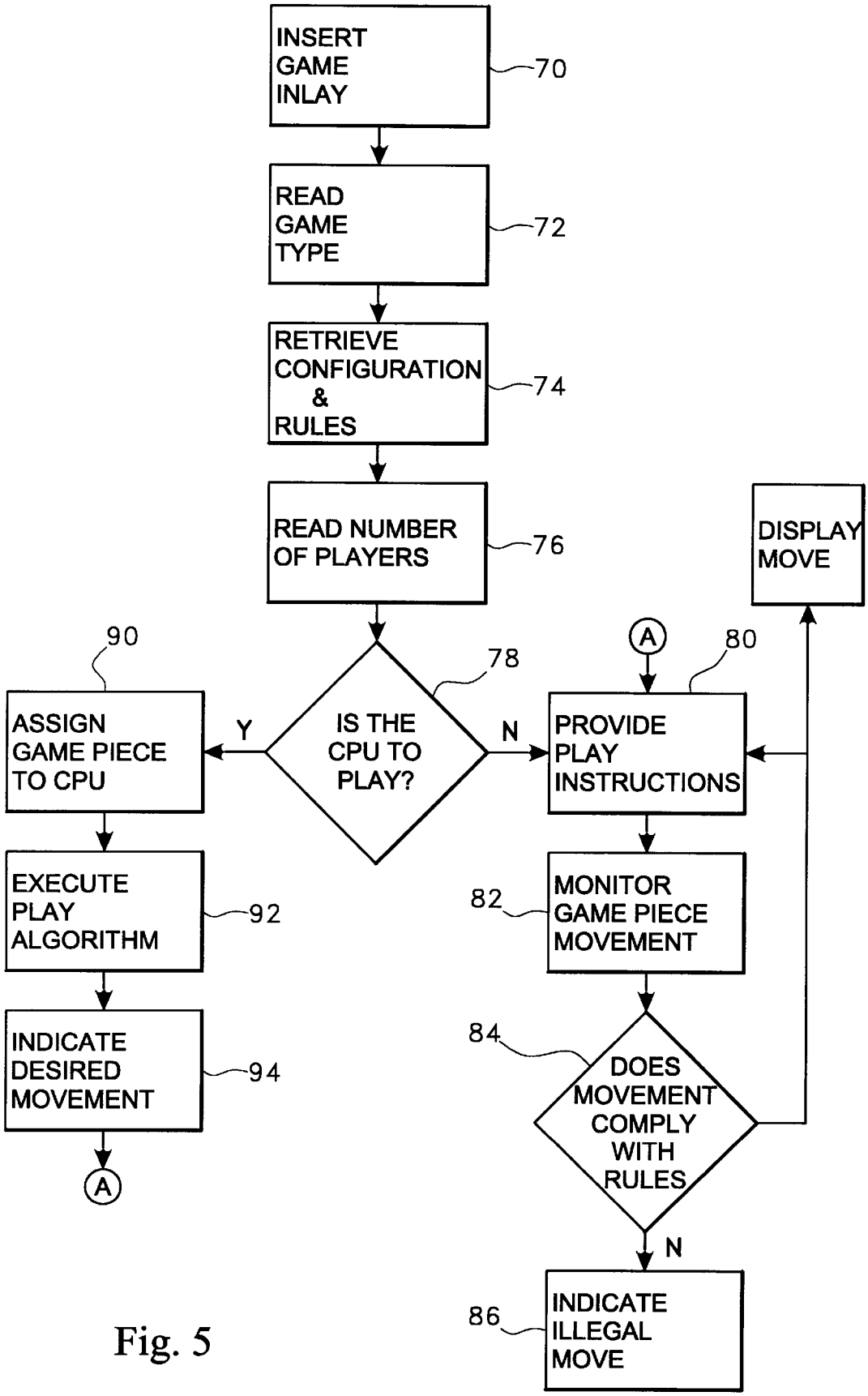
FIG. 5 is a block diagram schematic showing a preferred method of operation for the present invention.

Since the CPU 14 (FIG. 1) can identify the identity of the game pieces and the secondary pieces on the board, the CPU is capable of reading all the information it needs in order to monitor and/or participate in the play of the game. Referring to FIG. 5, a flow chart is provided that shows an exemplary method of operation of the present invention interface assembly. As is indicated by block 70, players select a game board insert 20 (FIG. 1) and place that insert 20 on top of the interface assembly 12 (FIG. 1). The type of game board insert selected is then read into the CPU 14 (FIG. 1) via the buttons 38 (FIG. 1) on the interface assembly or a computer keyboard 40 (FIG. 1), as indicated by block 72. Once the game board inlay is recognized by the CPU, the CPU can retrieve the game layout and the rules of the game from a memory, as is indicated by block 74. The buttons on the interface assembly or a computer's keyboard are also used to read the number of players to the CPU and to indicate to the CPU whether the CPU will be acting as a player during play. (See block 76 and block 78, respectively.) If the CPU is not to play as a player, the function of the CPU is to monitor play and display different aspects of play on the display screen 28 (FIG. 1). The CPU displays an image of the game board as its default image. The displayed game board shows the current position of the game pieces and overall status of play. As needed, the CPU will generate instructions for the game on the display screen, as is indicated by block 80. The instructions may be as simple as indicating whose turn it is to play. However, if a player chooses, a player can instruct the CPU to provide detailed instructions on possible moves in accordance with the rules. A player can request such information from the CPU using either the buttons on the interface assembly or the computer keyboard.

During play, each player physically moves his/her game pieces around the game inlay. As the game pieces are moved, the game pieces engage the identification units 50 (FIG. 2) under the playing field and the CPU is instructed as to the current position of each player's game pieces. As is indicated by block 82 and block 84, the CPU monitors the change in the position of each player's game piece and checks to see if such a move is in accordance with game rules. If the movement of a game piece is inappropriate, the CPU will provide an indication either visually or audibly, as indicated by block 86. The CPU will continue to monitor and display play until a winner is determined.

As is indicated by block 78 and block 90, if the CPU is to participate as a player in the game, a human player must assign a game piece to the CPU. As with all information transfers from the player to the CPU, the player can enter that information either through the buttons on the interface assembly or via the computer keyboard. After play has begun, the CPU executes the appropriate play algorithms and indicates where it wants its game pieces moved by showing the intended position of the game pieces on the display screen. (See block 92 and block 94). Human players may then move the game pieces assigned to the CPU on behalf of the CPU. The CPU monitors the movements of its own pieces and indicates to the other players whether or not its game pieces were moved correctly.

Figure 6:
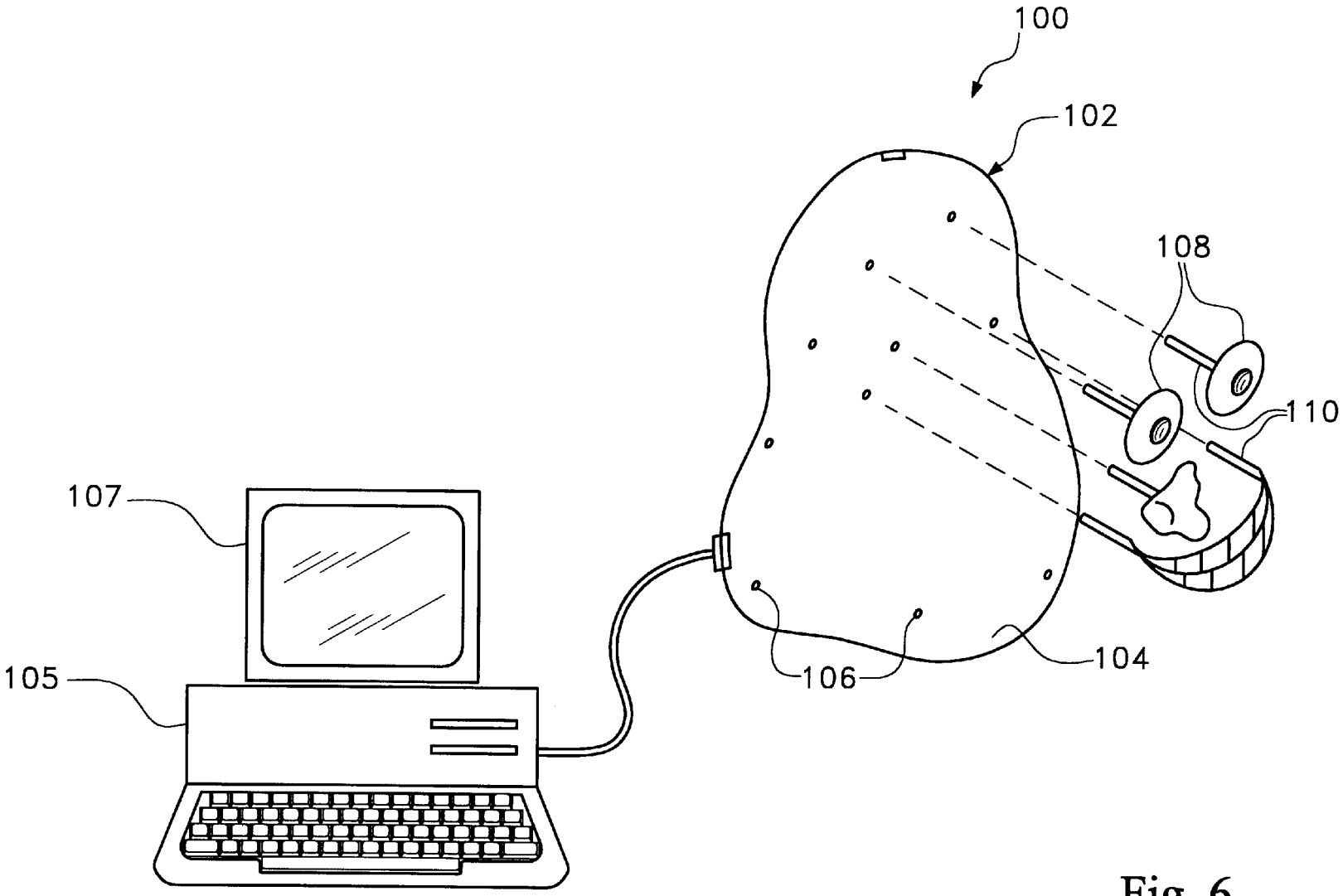
FIG. 6 shows an alternate embodiment of the present invention in conjunction with a personal computer.

Referring to FIG. 6, an alternate embodiment of the present invention interface assembly 100 is shown. In this embodiment, the interface assembly is not being used to connect a board game to a computer. Rather, the interface assembly 100 is being used to connect a doll FIG. 102 to a computer 105. The doll FIG. 102 illustrated is a Mr. Potato Head®, however any doll with interchangeable parts can be used. In a Mr. Potato Head® figure, a base form 104 is provided that is the shape of a potato. The base form 104 has various holes 106 manufactured in it through which a person can add decorative components 108, such as eyes, ears, mouths, noses, clothes and the like.

In the shown embodiment, an identification unit, such as that described in regard to FIG. 2, is disposed inside the base form 104 at the bottom of each of the connection holes 106. Each of the decorative components 108 have a pin element 110 that is used to connect the decorative components 108 to the base form 104. The pin elements 110 identify the identity of the different pieces in the-same manner as has been previously described. The base form 104 is coupled to a computer 105. The computer 105 reads the position of the various decorative components 108 and the identity of the various decorative components 108. As such, the computer 105 is capable of creating a image on the computer display 107 that corresponds to the actual form being made. This image can then be printed so that a child can have a recording of the different forms that child has produced.

It will be understood that the use of a Mr. Potato Head® is merely exemplary and many other three-dimensional forms can also be used. The three dimension forms can be any structure to which different parts are selectively added. For example, the form could be a puzzle that has different puzzle pieces. The form could also be a doll house that is selectively decorated by a child.

It will be understood that the embodiments of the present invention described and illustrated herein are merely exemplary and a person skilled in the art can make many variations to the embodiments shown without departing from the scope of the present invention. It should also be understood that the various elements from the different embodiments shown can be mixed together to create alternate embodiments that are not specifically described. All such variations, modifications and alternate embodiments are intended to be included within the scope of the present invention as defined by the appended claims.

What is claimed is:

1. A data input interface device for a personal computer that can run software for a plurality of games that utilizes different game boards, said data input interface comprising:

a plurality of sets of game pieces, wherein each set of same pieces contains game pieces of different types that are used in the play of one of the plurality of games;

a physical rendition of each of the same boards for which a set of game pieces is provided, wherein each said rendition of a game board contains a unique plurality of positions on which game pieces are placed during play;

a base structure that receives said rendition of each game board;

a plurality of identification units disposed within said base structure for identifying each of the game pieces placed on a rendition of a game board during play, identifying in which of said plurality of positions said game pieces are located, and providing output signals for each of said game pieces that identifies its position and identity, wherein said output signals are readable by the personal computer and used in the running of the software of the game.

2. The device according to claim 1, wherein said base structure contains at least one hole at each of said plurality of positions on said rendition of the board game, and each of said game pieces contains a pin element that passes into said at least one hole when a game piece is placed onto one of said positions on said rendition of the board game.

3. The device according to claim 2, wherein said identification units identify each of said game pieces by said pin element that extend from each of said game pieces.

4. The device according to claim 1, wherein said identification units identify said game pieces by the physical structure associated with said game pieces.

5. The device according to claim 1, wherein said identification units identify said game pieces by the electrical properties associated with said game pieces.

6. The device according to claim 1, wherein said identification units identify said game pieces by the magnetic properties associated with said game pieces.

7. The device according to claim 1, wherein said rendition of said board game is selectively removable and replaceable on said base structure, wherein said game board is interposed between said base structure and said game pieces.

8. A data input interface system for a computer game, comprising:

a plurality of game boards and game pieces for use on said game boards, wherein each of said game boards contains playing spaces of varying configurations upon which said game pieces are placed during play;

a base structure for supporting a selected one of said game boards, wherein said selected one of said game boards may be any one of said plurality of game boards;

a matrix of identification units disposed in said base structure, wherein at least one identification unit is disposed proximate each of said playing spaces on said selected one of said game boards when said selected one of said game boards is placed on said base structure, wherein said at least one identification unit provides an output signal that can be read by a personal computer and identifies a location and game piece type for each of said game pieces placed on a playing space during play.

9. The device according to claim 8, wherein each of said game boards contains at least one hole at each of said playing spaces, wherein each said hole aligns with an identification unit from said matrix of identification units; and each of said game pieces contains a pin element that passes into said at least one hole when a game piece is placed onto one of said play spaces.

10. The device according to claim 9, wherein said identification units identify each of said game pieces by said pin element that extend from each of said game pieces.

* * * * *